US005865217A

United States Patent [19]

Giacomelli et al.

[11] Patent Number: 5,865,217

[45] Date of Patent: Feb. 2, 1999

[54] FILL SYSTEM INCLUDING A FLEXIBLE NOZZLE FOR REDUCING THE MIXING OF PRODUCT AND AIR DURING CONTAINER FILLING

[75] Inventors: Peter Giacomelli, Buffalo Grove; Robert Muns, Gurnee; Anders Andrén, Palatine; Pär Svensson, Chicago, all of Ill.

[73] Assignee: Tetra Laval Holdings&Finance, SA, Pully, Switzerland

[21] Appl. No.: 812,411

[22] Filed: Mar. 6, 1997

Related U.S. Application Data

[63] Continuation-in-part of Ser. No. 691,747, Aug. 1, 1996.

[51] Int. Cl.[6] ..... B67C 3/26

[52] U.S. Cl. ..... 141/263; 141/172; 141/181; 141/251; 141/255; 141/270; 141/275; 141/318; 141/374; 141/388; 222/494

[58] Field of Search ..... 141/148, 149, 141/152, 172, 114, 251, 255, 263, 266, 270, 275, 318, 374, 375, 368, 386, 388, 181; 239/DIG. 12, 590, 601, 602; 222/490, 494

[56] References Cited

U.S. PATENT DOCUMENTS 2,283,093 5/1942 Rosenthal et al. ..... 141/374
4,360,996 11/1982 Rutter ..... 53/496
4,915,146 4/1990 Warner ..... 141/144

*Primary Examiner*—David J. Walczak
*Assistant Examiner*—Timothy L. Maust
*Attorney, Agent, or Firm*—Michael A. Catania

[57] ABSTRACT

A filling system of a packaging machine is set forth that reduces the mixing of product and air during the filling of the container with a flowable material such as low fat milk. The fill pipe of the filling system has an elliptical cross-section which provides for a reduced velocity of the flowable material entering the container while allowing for an increased production time of the packaging machine. The fill system is especially adopted to fill containers having a rectangular cross-section. Connected to the fill pipe is a nozzle with flaps designed to substantially conform and engage with the sidewalls of a container. When the flaps are urged to an open position, the mixing of air and product is inhibited as the flowable material is dispensed into the container through the nozzle and as a moving mechanism is operated to relatively move the container and nozzle from a first to a second position. The fill pipe has an elongate body, an inlet end and an outlet end. The inlet end is in flow communication with the fill pump and may have a circular cross-section. The outlet end is in flow communication with the nozzle and has an elliptical cross-section. The cross-section of the elongate body gradually transforms from a circular cross-section at the inlet end to an elliptical cross-section at the outlet end.

40 Claims, 5 Drawing Sheets

FILL SYSTEM INCLUDING A FLEXIBLE NOZZLE FOR REDUCING THE MIXING OF PRODUCT AND AIR DURING CONTAINER FILLING

CROSS REFERENCES TO RELATED APPLICATIONS

This application is a continuation-in-part of copending application Ser. No. 08/691,747 filed on Aug. 1, 1996.

STATEMENT REGARDING FEDERALLY SPONSORED RESEARCH OR DEVELOPMENT

Not Applicable

BACKGROUND OF THE INVENTION

1. Field of the Invention

The present invention relates to a method and apparatus for filling containers, and more particularly, to a filling system including a fill pipe with an elliptical cross-section.

2. Description of the Related Art

Packaging machines are known that integrate the various components necessary to fill and seal a container into a single machine unit. This packaging process, generally stated, includes feeding cartons blanks into the machine, sealing the bottom of the cartons, filling the cartons with the desired contents, sealing the tops of the cartons, and then off loading the filled cartons for shipping.

Trends within the field of packaging machines point toward increasingly high capacity machines intended for rapid, continuous filling and sealing of a very large number of identical or similar packaging containers, e.g., containers of the type intended for liquid contents such as milk, juice, and the like. One such machine is disclosed in U.S. Pat. No. 5,488,812, issued Feb. 6, 1996, and entitled "Packaging Machine." The machine disclosed in the '812 patent includes a plurality of processing stations, each station implementing one or more processes to form, fill and seal the containers. Each of the processing stations is driven by one or more servomotors that drive the various components of each of the processing stations. Other such machines include the TR-6™ and the TR-8™ packaging machines available from Tetra Rex Packaging Systems, Incorporated of Buffalo Grove, Ill.

The increased throughput and decreased size requirements of packages on their packaging machines have increased the demands that are placed on the fill systems that are employed. Various apparatus and corresponding methods for filling containers, such as gable-top containers, have therefor been devised for these machines. In accordance with one of the more popular filling methods, the container is lifted from a conveyor to a fill pipe by means of a lifting mechanism. The container lifting mechanism gradually lowers the container as product is dispensed through the fill tube. The container then again engages the conveyor where it is transported to a top sealing station.

Alternatively, the filling and top sealing operations may be performed at a single location within the machine. In such instances, the container may be top sealed after it has been lowered from the fill pipe. Such a method and apparatus are shown and described in the foregoing '812 patent, and, further, in U.S. Ser. No. 08/315,414, filed Sep. 28, 1994, and entitled "Control System For A Packaging Machine."

One problem encountered when attempting to increase the speed with which a container is filled with product relates to the foaming and turbulence that occurs as a result of air and product mixing in the container. Generally stated, foaming increases as the speed with which the container is filled increases. When foaming is excessive, the product splashes into the sealing areas of the container resulting in improper sealing in subsequent sealing operation and/or contamination of the sealing area resulting in a reduction in the hygiene of the seal than would otherwise be obtained. The rate at which the container may be filled is thus limited by the foaming that occurs for a given fill rate. This problem is exacerbated with containers having a rectangular cross-section. A reduction in the velocity of the flowable material flowing through a fill pipe with a circular cross-section would lead to a reduction in the number of units produced per hour which is not a viable solution to the problem.

BRIEF SUMMARY OF THE INVENTION

One aspect of the present invention is a fill pipe for utilization in conjunction with a packaging machine for filling containers that have sidewalls defining a cross-sectional area. The packaging machine has a fill pump for pumping a flowable material such as milk. The fill pipe includes an elongate body, an inlet end and an outlet end. The elongate body has an interior passageway with at least a portion of the interior passageway having an elliptical cross-section. The inlet end provides for flow communication between the fill pump and the interior passageway. The outlet end is in flow communication with interior passageway and provides for dispensing of the flowable material from the fill pipe. The outlet end has an elliptical cross-section.

The entire interior passageway may have an elliptical cross-section. The inlet end may have a circular cross-section. At least a portion of the interior passageway nearest the inlet end may have a circular cross-section. The elongate body may include a plurality of portions. The portion adjacent the inlet end may have a circular cross-section and the portion adjacent the outlet end may have an elliptical cross-section. Each of the other portions may have cross-sections which are gradually more elliptical the closer the portion is to the outlet end thereby gradually transforming the cross-section of the fill pipe from a circular cross-section at the inlet end to an elliptical cross-section at the outlet end.

The sidewalls of the container may define a rectangular cross-section. More specifically, the sidewalls of the container may define a cross-section of 95 mm×70 mm. Alternatively, the container sidewalls may define an octagonal cross-section.

Further, the container sidewalls may define a hexagonal cross-section. Yet further, the container sidewalls may define a circular cross-section.

The fill pipe may further comprising a nozzle connected to the outlet end of the fill pipe. The nozzle includes a collar and a plurality of flaps. The collar connects the nozzle to the outlet end of the filling pipe. The collar has an elliptical cross-section. The plurality of flaps are formed from a flexible material and extend from the collar. The plurality of flaps are biased to a closed state. The nozzle seals the outlet end of the fill pipe when in the closed state. The collar may be composed of a silicone material of a predetermined durometer capable of maintaining the nozzle on the outlet end of the fill pipe during operation of the packaging machine.

The elongate body may be composed of stainless steel or alternatively a plastic material. The flowable material is a liquid food product. The flowable material may be milk, especially low fat milk. The elliptical cross-section of the outlet end and at least a portion of the elongate body may provide for a fill pipe capable of filling a container at a velocity at least twenty percent lower than a fill pipe having a circular cross-section with a circumference substantially equal to the circumference of the inlet end. In this manner, the same quantity of flowable material is delivered to the container in the same amount of time as a fill pipe with a circular cross-section.

Another aspect of the present invention is a fill system for a packaging machine. The fill system includes a container, a fill pump, a fill pipe, a nozzle and a moving means. The container has a cross-section defined by a plurality of sidewalls, an interior bottom engaging the sidewalls, and an open top. The fill pump pumps a flowable product. The fill pipe has an inlet receiving the flowable product under pressure from the fill pump and an outlet overlying the container. The nozzle is disposed over the outlet end of the fill pipe. The nozzle includes a collar and a plurality of flaps. The collar connects the nozzle to the outlet end of the fill pipe. The plurality of flaps are formed from a flexible material and extend from the collar. The plurality of flaps are biased to a closed state. The nozzle seals the outlet end of the fill pipe when in the closed state. The moving means moves the container and nozzle toward one another at a first position in which the nozzle is disposed in the interior bottom of the container and a second position in which the nozzle is disposed distal from the interior bottom of the container. The fill pump operates to pump the liquid product through the fill pipe under pressure when the container and nozzle are disposed in their relative first position to thereby urge the flaps of the nozzle from the closed state to an open state. The flaps of the nozzle are dimensioned to substantially conform and seal with the sidewalls of the container when the flaps are urged to the open state to thereby inhibit mixing of air and product as liquid product is dispensed into the container through the nozzle and the moving means is operated to relatively move the container and nozzle from the first position to the second position.

The fill pipe includes an elongate body having an interior passageway with at least a portion of the interior passageway having an elliptical cross-section. The inlet end provides flow communication between the fill pump and the interior passageway. The outlet end is in flow communication with interior passageway and dispenses the liquid product from the fill pipe into the nozzle. The outlet end has an elliptical cross-section.

Another aspect of the invention is a method for filling a container with a flowable material. The method commences with the step of providing a container having sidewalls defining a predetermined cross-section. The next step is positioning the container beneath a fill pipe of a filling machine. The fill pipe includes an elongate body, an inlet end and an outlet end. The elongate body has an interior passageway with at least a portion of the interior passageway having an elliptical cross-section. The inlet end provides for flow communication between a fill pump and the interior passageway. The outlet end is in flow communication with interior passageway. The outlet end has an elliptical cross-section. The next step is bringing a bottom portion of the container and a nozzle that is disposed at the outlet end of the fill pipe proximate to one another. The next step is pumping a flowable material through the fill pipe, through the nozzle and into the container. The final step is moving the bottom of the container and the nozzle away from one another as the container is filled with the flowable material. The movement being controlled to maintain a lower end of the nozzle slightly above a surface level of the flowable material in the container.

It is a principal object of the present invention to provide a fill system for a packaging machine to fill containers with rectangular cross-sections at a reduced velocity.

It is another object of the present invention to provide a fill system for a packaging machine to fill containers with rectangular cross-sections with a substantial reduction in turbulence and foaming.

It is yet another object of the present invention to provide a fill system for a packaging machine to fill containers with rectangular cross-sections at an increased operating speed for the packaging machine.

It is yet another object of the present invention to provide a fill pipe with an elliptical cross-section.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a schematic view of a typical filling machine that may incorporate the fill system of the present invention.

Figure 2:
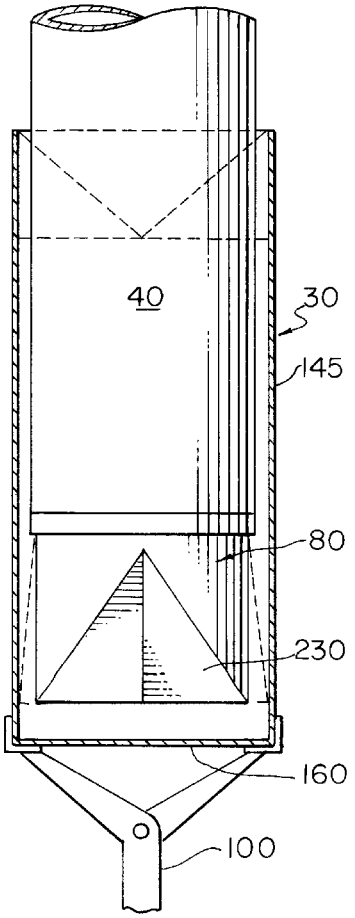

There is illustrated in FIG. 2 a side view of a filling nozzle and a filling pipe of the present invention disposed in an empty container.

Figure 3:
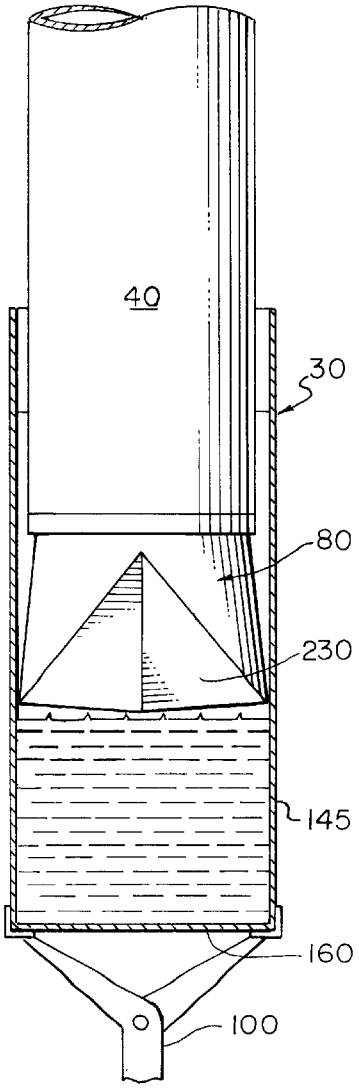

There is illustrated in FIG. 3 a side view of a filling nozzle and a filling pipe of the present invention disposed in a partially-filled container.

Figure 4:
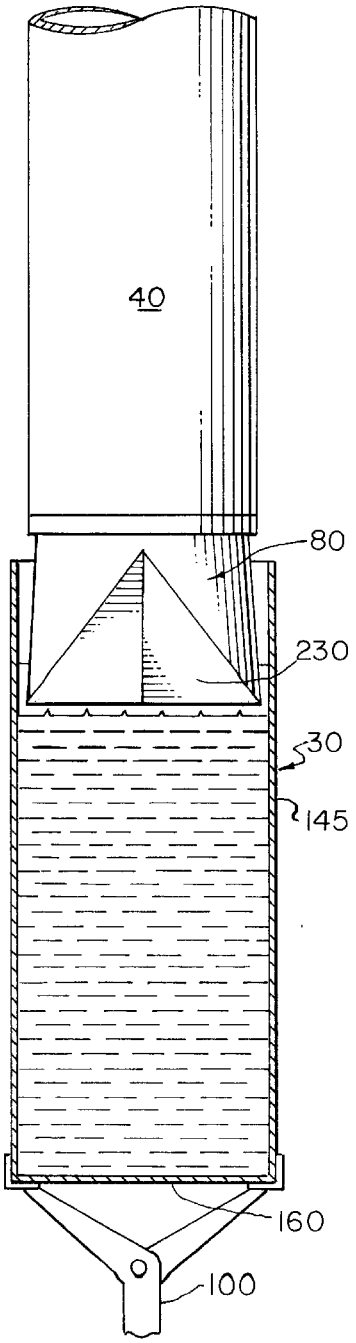

There is illustrated in FIG. 4 a side view of a filling nozzle and a filling pipe of the present invention disposed in a filled container.

Figure 5:
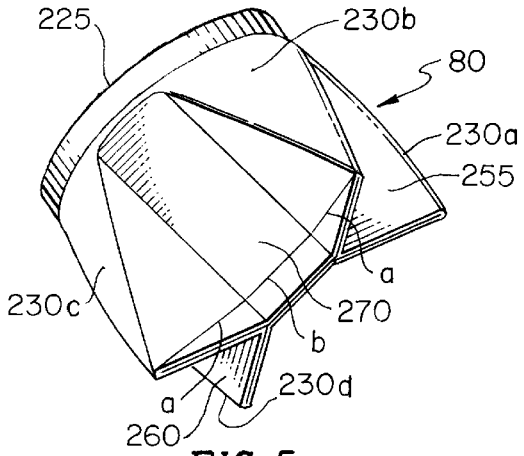

There is illustrated in FIG. 5 a perspective view of a filling nozzle of the present invention for utilization in conjunction with a fill pipe having an elliptical cross-section at its outlet end in order to fill a container having a rectangular cross-section.

Figure 6:
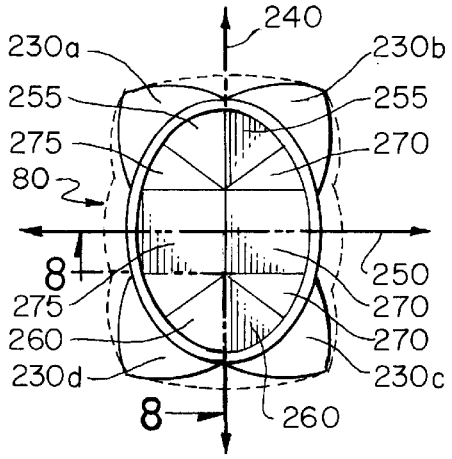

There is illustrated in FIG. 6 a top plan view of the filling nozzle of FIG. 5 showing the position of its various components in both open and closed positions.

Figure 7:
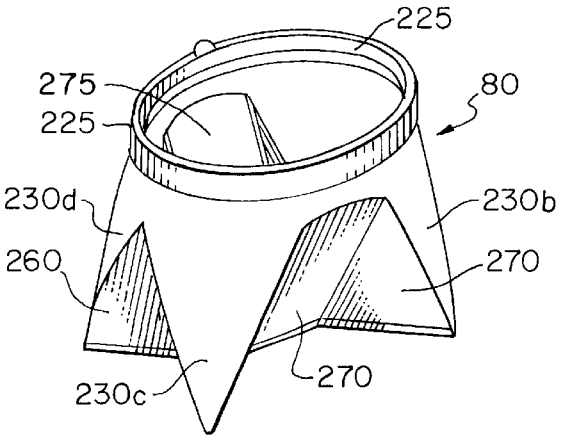

There is illustrated in FIG. 7 a top perspective view of the filling nozzle of FIG. 5.

Figure 8:
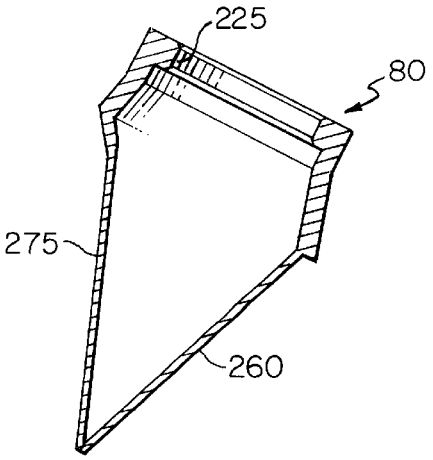

There is illustrated in FIG. 8 a cross-sectional view of the filling nozzle of FIG. 6 along the 8—8 line.

Figure 9:
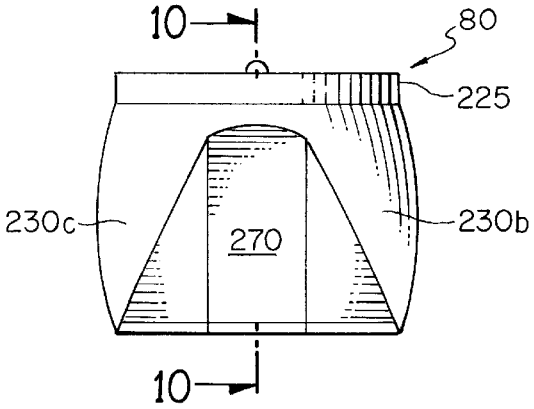

There is illustrated in FIG. 9 a side view of the filling nozzle of FIG. 5

Figure 10:
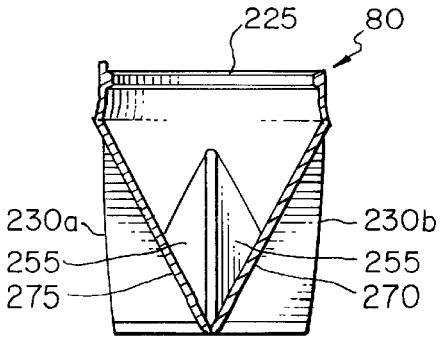

There is illustrated in FIG. 10 a cross-sectional view of the filling nozzle of FIG. 9 along the 10—10 line.

Figure 11:
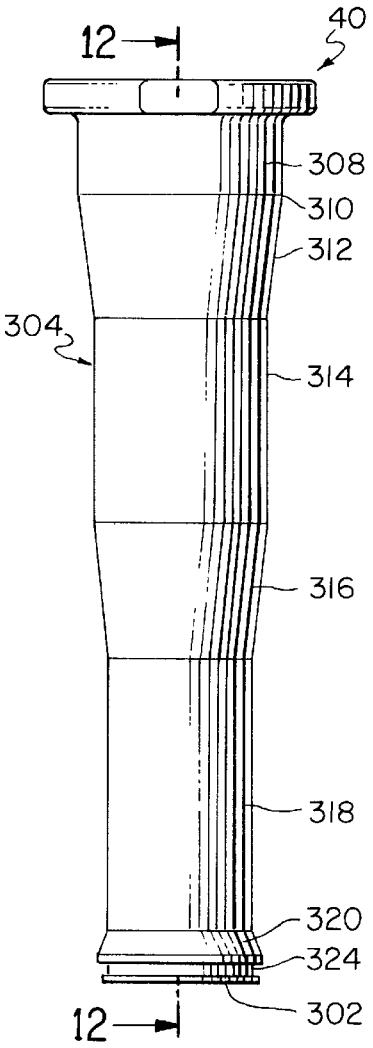

There is illustrated in FIG. 11 a side view of a filling pipe of the present invention.

Figure 12:
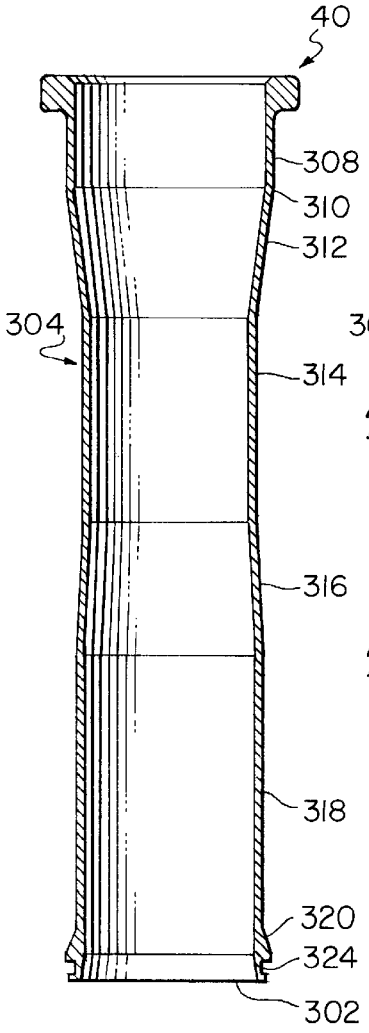

There is illustrated in FIG. 12 a cross-sectional view of the filling pipe of FIG. 11 along the 12—12 line.

Figure 13:
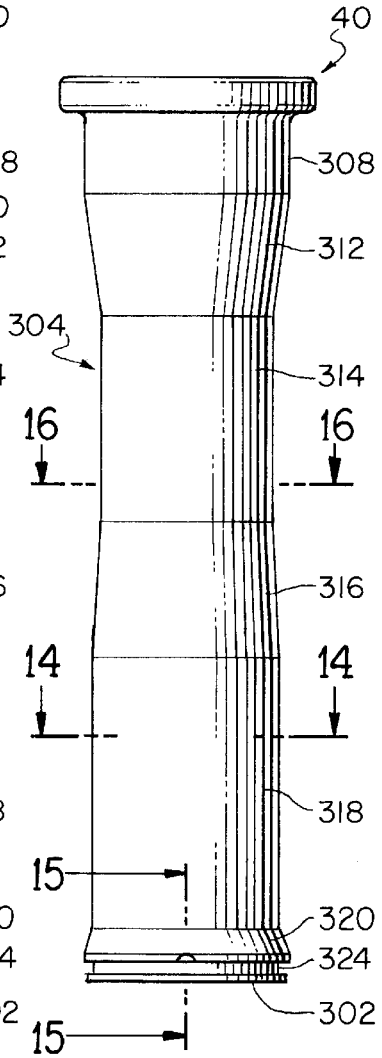

There is illustrated in FIG. 13 a more detailed side view of a filling pipe of the present invention.

Figure 14:
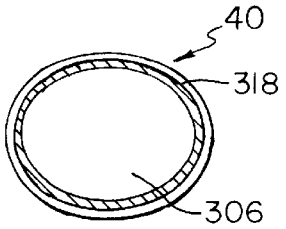

There is illustrated in FIG. 14 a cross-sectional view of the filling pipe of FIG. 13 along the 14—14 line.

Figure 15:
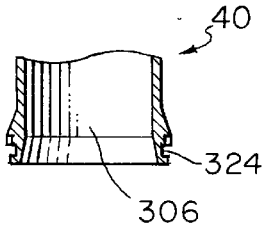

There is illustrated in FIG. 15 a cross-sectional view of the filling pipe of FIG. 13 along the 15—15 line.

Figure 16:
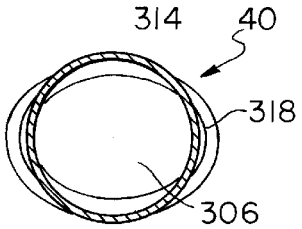

There is illustrated in FIG. 16 a cross-sectional view of the filling pipe of FIG. 13 along the 16—16 line.

Figure 17:
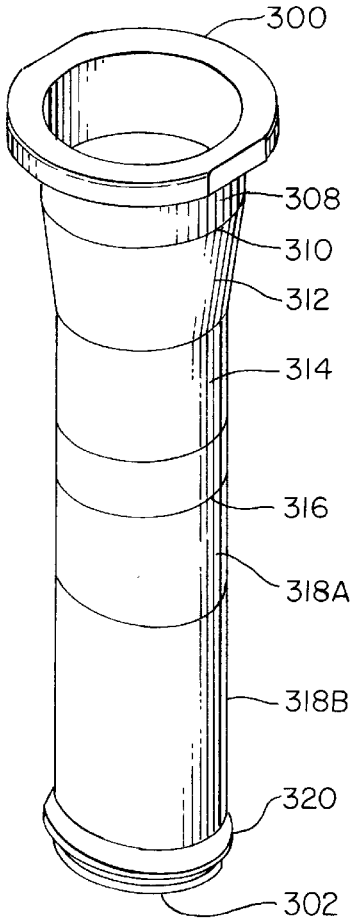

There is illustrated in FIG. 17 a top perspective view of a fill pipe of the present invention.

Figure 18:
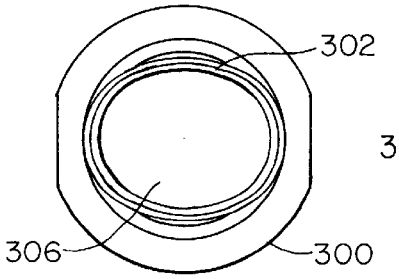

There is illustrated in FIG. 18 a bottom plan view of the fill pipe of FIG. 17.

Figure 19:
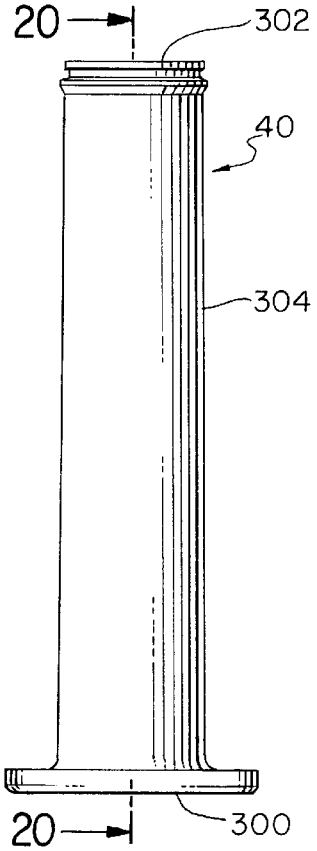

There is illustrated in FIG. 19 a side view of an alternative embodiment of a fill pipe of the present invention.

Figure 20:
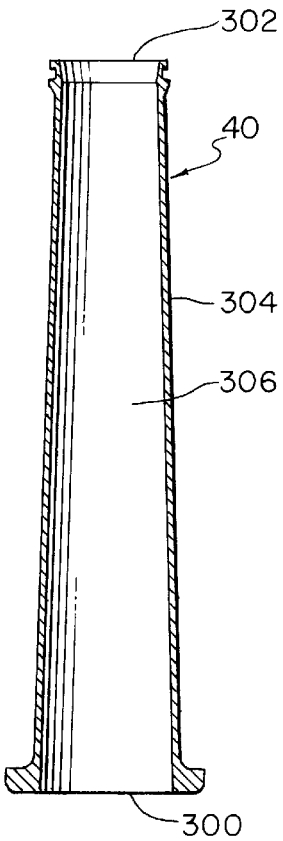

There is illustrated in FIG. 20 a cross-sectional view of the fill pipe of FIG. 19 along the 20—20 line.

Figure 21:
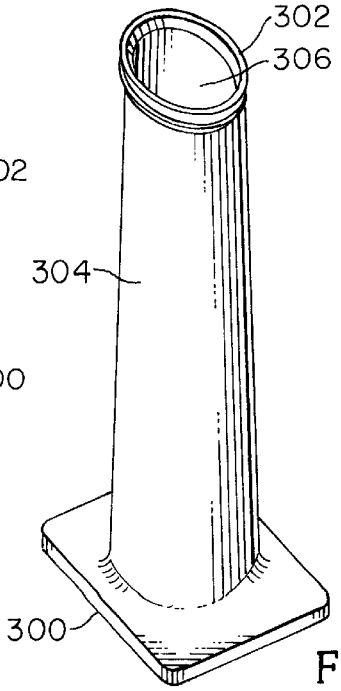

There is illustrated in FIG. 21 is a top perspective of the fill pipe of FIG. 19.

Figure 22:
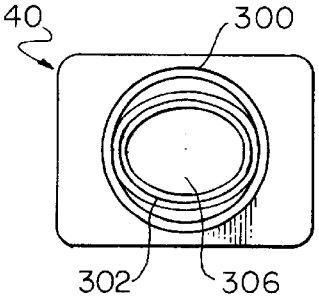

There is illustrated in FIG. 22 a top plan view of the fill pipe of FIG. 19.

DETAILED DESCRIPTION OF THE INVENTION

Figure 1:
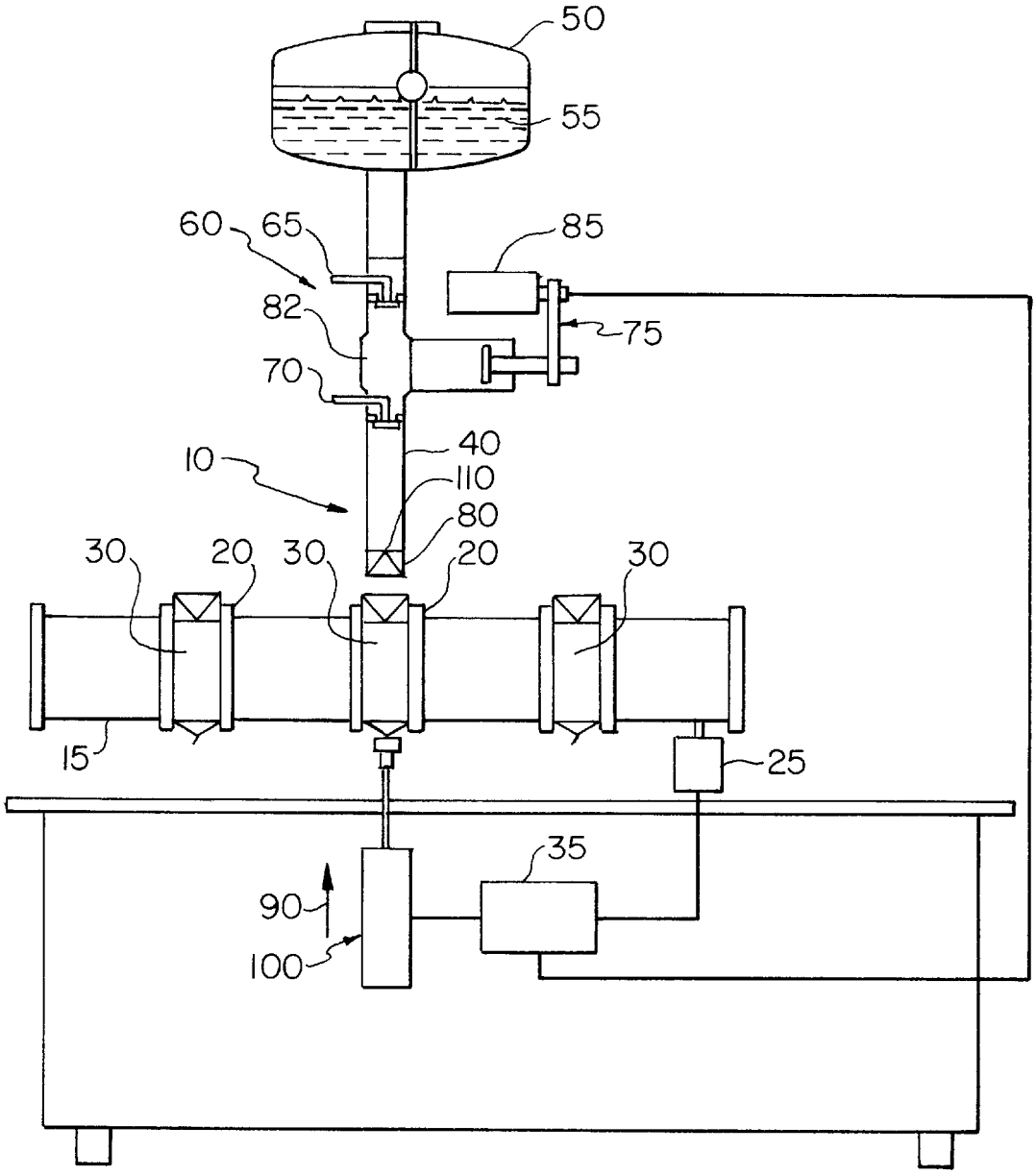

There is illustrated in FIG. 1 a schematic view of a typical filling machine that may incorporate the fill system of the present invention. However those skilled in the pertinent art will readily recognize that other filling machines may be employed in practicing the present invention without departing from the scope and spirit of the present invention. As shown in FIG. 1, the filling system shown generally at 10 is constructed and operated in the manner described herein. A conveyor 15 having a plurality of container support members 20 is driven, for example, by a motor 25, such as a servomotor or a belt mechanism. The support members 20 each support a single, open topped container 30 that has its bottom sealed. The conveyor 15 is driven by motor 25 under the control of, for example, a programmable control system 35, or the like, to present the containers 30 successively below a fill pipe 40 of the fill system 10.

A storage or balance tank 50 containing a flowable material 55 is connected to provide a flow of the flowable material through a flow control system 60. The flow control system 60, generally stated, comprises an inlet valve 65, an outlet valve 70, pump mechanism 75, the fill pipe 40, and a nozzle 80. The inlet and outlet valves 65 and 70 are operated to control the flow of the flowable material into and from a pump chamber 82 of the pump mechanism 75. The pump mechanism 75 may be any type of pump mechanism, such as one disclosed in U.S. Pat. No. 4,877,160, which pertinent parts are hereby incorporated by reference. The pump mechanism 75 may be driven, for example, by a servomotor 85 under the direction of the programmable control system 35.

As shown in FIG. 1, the containers 30 are successively brought below the nozzle 80 for filling with the flowable material, such as low fat milk. To this end, each container 30 is lifted in the direction of arrow 90 so that the nozzle 80 is disposed in the interior of the container. This lifting may be done using a lifting mechanism 100 that executes a motion profile under the direction of, for example, the programmable control system 35. One such lifter mechanism and corresponding carton gripping mechanism are disclosed in U.S. Ser. No. 08/315,410, filed Sep. 28, 1994. Alternatively, the lifting may be accomplished by a carton gripper which grips each container 30 and through a hydraulic cylinder or the like, lifts the container toward the nozzle. The flow control system 60 is then operated to fill the container 30 with the flowable material as the container 30 is lowered from the nozzle 80 by the lifting mechanism 100, preferably maintaining the nozzle 80 above the surface level of the flowable material throughout this downward motion. Even more preferably, the flaps 130 are maintained approximately 2–3 mm above the surface of the flowable material being dispensed into the container 30.

The nozzle 80 is disposed over the outlet 110 of the fill pipe 40. The nozzle 80 includes a plurality of flaps which are made of a flexible material, such as FDA approved silicone or the like. The flaps are flexible between an open position in which the flowable material is allowed to flow therefrom and a closed position in which the nozzle seals the outlet end 110 of the fill pipe 40. The flaps are biased to a closed position, for example, by virtue of their inherent resiliency or by a separate mechanical biasing element. Movement of the flaps to their open position may ensue by virtue of the pressure of the flowable material against the inherent resiliency or through a separate mechanical opening element. The separate mechanical opening element may be a transformable wire as disclosed in copending U.S. Ser. No. 08/752,135 filed on Nov. 19, 1996, entitled "Flexible Nozzle Integrated With A Transformable Wire," which pertinent parts thereof are hereby incorporated by reference.

Some of the advantages of the present invention are exemplified in the filling process illustrated in FIGS. 2–4. There is illustrated in FIG. 2 a side view of a filling nozzle and a filling pipe of the present invention disposed in an empty container. There is illustrated in FIG. 3 a side view of a filling nozzle and a filling pipe of the present invention disposed in a partially-filled container. There is illustrated in FIG. 4 a side view of a filling nozzle and a filling pipe of the present invention disposed in a filled container. In an exemplary filling process, the bottom portion 160 of the container 30 and the nozzle 80 are brought proximate to one another while the nozzle 80 is in a closed state. The flaps 130 are then urged to the open state by, for example, the pressure of the flowable material against the flaps as produced by the pump mechanism 75 and/or gravity. Alternatively, an opening mechanism that directly engages the flaps to urge them to an open state may be employed, such as a movable plunger. Still further, the flaps 130 may be provided with electrically sensitive supports disposed therein or thereon that change shape in response to an electrical stimulus to thereby urge the flaps to their open and/or closed states.

The position of the flaps in the open state are shown in phantom in FIG. 2. As shown, the flaps 130 conform to and engage the sidewalls 145 of the container 30 to thereby form a seal with the sidewalls 145 that is sufficient to inhibit mixing between the flowable material and the ambient gas, such as air, during subsequent filling.

Product begins to be dispensed when the nozzle 80 and container 30 are in the relative position shown in FIG. 2. As product is dispensed into the container 30, the nozzle 80 and container 30 are moved relative to one another by, for example, the foregoing carton gripper to thereby begin extracting the nozzle from engagement with the interior of the container 30 during filling. During this extraction and filling process, the flaps 130 preferably remain in their open state and the motion profile used to cause the disengagement is preferably controlled to maintain the lower end of the nozzle 80 at a level slightly above the flowable material surface (see FIG. 3). Ultimately, as shown in FIG. 4, the container 30 is filled with the desired volume of product and the flaps 130 go to their closed state. To reduce the likelihood that a further amount of product will drip into the container 30, the pump mechanism 75 may provide a slight backpressure that assists in retaining the flaps 130 in their closed state. The container 30 is shown in an intermediate state in which the bottom has been sealed to form a flat bottom structure. Other bottom structures, however, may be utilized as well.

Without limitation, and with reference to FIGS. 2–4, the container 30 may have sidewalls 145 defining a cross-section of 95 mm×70 mm. However, those skilled in the pertinent art will recognize that the fill system of the present invention may be practiced with containers having cross-sections of various shapes and dimensions.

There is illustrated in FIG. 5 a perspective view of a filling nozzle of the present invention for utilization in conjunction with a fill pipe having an elliptical cross-section at its outlet end in order to fill a container having a rectangular cross-section. The nozzle 80 of FIG. 5 is particularly designed for use with a filling pipe having an outlet end with an elliptical cross-section. There is illustrated in FIG. 6 a top plan view of the filling nozzle of FIG. 5 showing the position of its various components in both open and closed positions. As previously shown in FIGS. 2–4, the nozzle 80 is positioned near the bottom of a container 30 during filling, and subsequently moved from the bottom as the container 30 fills with a flowable material. There is illustrated in FIG. 7 a top perspective view of the filling nozzle of FIG. 5. There is illustrated in FIG. 8 a cross-sectional view of the filling nozzle of FIG. 6 along the 8—8 line. There is illustrated in FIG. 9 a side view of the filling nozzle of FIG. 5. There is illustrated in FIG. 10 a cross-sectional view of the filling nozzle of FIG. 9 along the 10—10 line.

As illustrated in FIGS. 5–10, the nozzle 80 includes a collar portion 225 and a plurality of flaps and lugs extending from the collar portion 225. The collar 225 is of a substantially elliptical shape to accommodate an elliptical-shaped fill pipe outlet. A plurality of flaps and lugs extend from the collar 225. In the disclosed embodiment, there are four V-shaped lugs 230*a–d*. V-shaped lugs 230*a* and 230*b* are adjacent one another on opposite sides of major axis 240 and are preferably at a 45 degree angle Θ with respect to the major axis 240. V-shaped lugs 230*c* and 230*d* are adjacent one another on opposite sides of major axis 240 and are each, likewise, preferably at a 45 degree angle with respect to the major axis 240. V-shaped lugs 230*a* and 230*b* are disposed on a side of minor axis 250 opposite from V-shaped lugs 230*c* and 230*d*. Inwardly directed, inverted V-shaped flaps 255 connect adjacent V-shaped lugs 230*a* and 230*b* while inwardly directed, inverted V-shaped flaps 255 connect adjacent V-shaped lugs 230*c* and 230*d*. Non-adjacent V-shaped lugs 230*b* and 230*c* are connected with one another by an inwardly directed tri-panel flap 270 while non-adjacent V-shaped lugs 230*a* and 230*d* are connected with one another by a further inwardly directed tri-panel flap 275. By way of example, if the nozzle 80 is designed to fill a 95 mm×70 mm rectangular container, the length "a" is preferably about 35 mm in length (or ½ of the width of the container to be filled), and length "b" may be about 25 mm in length (or the difference between the length of the longer container sidewall and 2**a*). As illustrated in phantom in FIG. 5, the nozzle 80 opens to a generally rectangular cross-section that can engage the sidewalls of a rectangular container to reduce the mixing of product and air during container filling. A fill system employing the embodiment of the nozzle of FIGS. 5–10 may be operated in accordance with the foregoing description of the filling process provided in connection with FIGS. 2–4.

As shown in FIGS. 6 and 9, when the nozzle 80 is in the open state, the V-shaped lugs 230*a–d*, V-shaped flaps 255 and 260, and tri-panel flaps 270 and 275 extend outward so that the lower edges of the opened nozzle conform to a generally rectangular cross-section and engage the sidewalls 145 of the container 30. Opening of the flaps to the illustrated position may take place by generating a slight overpressure in the fill tube 40 that acts against the inherent resiliency that biases the flaps to the closed position.

Alternative manners of opening the nozzle 80 are likewise contemplated. For example, a mechanism applying a force against the fold ridges may be utilized such as a downwardly movable cylindrical plunger (not shown) having an aperture through which the flowable material may flow. Preferably, the vertices of the V-shaped lugs 230*a–d* flare to engage interior corner portions of the container. Such flaring may be generated in accordance with any of the foregoing methods for opening the nozzle 80. Where the nozzle 80 is opened solely using an overpressure of the flowable material, the nozzle is preferably maintained below the level of the flowable material in the container and the overpressure creates an upward force against the flaps of the nozzle to thereby cause the flaps to flare outwardly against the sidewalls of the container.

The nozzle 80 may be made from any suitable flexible material such as soft plastic or rubber of suitable hardness. In the case of packaging foodstuffs, such as low fat milk, the nozzle 80 may more preferably be made from approved nitrile, silicone rubber, or the like. In a preferred embodiment, the collar 225 is composed of a 80-durometer silicone material to provide strength and rigidity to the nozzle in order to maintain the nozzle 80 on the fill pipe 40 during operation of the packaging machine. A 80 durometer silicone material for the collar 225 is available from Dow Corning.

It will be understood that the nozzles of the present invention may take on any number of different forms which may substantially conform to the cross-sectional area of the container to be filled when the flaps are in an open position. For example, the container cross-section may be hexagonal, octagonal, round, etc., the illustrated embodiments being merely exemplary.

An important aspect of the present invention is the fill pipe 40. As previously mentioned, the filling of a container having a rectangular cross-section with a fill pipe having a circular cross-section may lead to foaming and turbulence. A reduction in the velocity of the flowable material into the container 30 may resolve these problems however it also reduces the number of units (containers filled and sealed) produced in an hour. The fill pipe of the present invention resolves all of these problems.

There is illustrated in FIG. 11 a side view of a filling pipe of the present invention. There is illustrated in FIG. 12 a cross-sectional view of the filling pipe of FIG. 11 along the 12—12 line. As shown in FIGS. 11 and 12, the fill pipe 40 has an inlet end 300 and an outlet end 302. The inlet end 300 is connected to the pump mechanism 75 and the outlet end 302 is connected to the nozzle 80. The fill pipe 40 is defined by an elongate body 304 having an internal passageway 306 extending therethrough. The internal passageway 306 provides for flow communication between the pump mechanism 75 and the nozzle 80 thereby allowing for a flow of flowable material from the pump mechanism 75 into a container 30.

In this embodiment of the fill pipe 40, the elongate body 304 is composed of a plurality of portions 308–320. The inlet end 300 has a circular cross-section for facilitated engagement with most pump mechanisms. However, the outlet end 302 has an elliptical, or oval, cross-section. The plurality of portions 308–320 have cross-sections which depend on their proximity to either the inlet end 300 or the outlet end 302. The portions 308, 310 and 312 have cross-sections which are substantially circular with portion 308 having a more circular cross-section than portion 312. The portions 316, 318 and 320 have cross-sections which are substantially elliptical with portion 320 having a more elliptical cross-section than portion 316.

In this manner, the fill pipe 40 is capable of delivering a flowable material to a container 30 at a velocity of at least twenty percent lower than that of fill pipe having only a circular cross-section throughout, while the fill pipe 40 delivers an equal amount of flowable material into the container 30 in an equal time period as a fill pipe having only a circular cross-section. The fill pipe 40 of the present invention accomplishes this feat with substantial reduction in foaming and turbulence thereby allowing for the packaging machine to operate at a higher capacity, upwards to fifty percent faster. For example, a packaging machine producing a gabled top carton having a cross-section of 95 mm×70 mm using a fill pipe having a circular cross-section may produce four thousand cartons per hour. While that same packaging machine using a fill pipe 40 of the present invention, along with a corresponding nozzle 80 of the present invention, will produce upwards to six thousand cartons per hour.

There is illustrated in FIG. 13 a more detailed side view of a filling pipe of the present invention. The embodiment of the fill pipe 40 of the present invention shown in FIG. 13 has a greater circumference for the lower portions 316–320 than that of the fill pipe 40 of FIG. 1. There is illustrated in FIG. 14 a cross-sectional view of the filling pipe of FIG. 13 along the 14—14 line. As is shown in FIG. 14, the interior passageway and the portion 318 have an elliptical, or oval, cross-section. The elliptical cross-section for the filling pipe 40 has proven to be quite beneficial for filling containers 30 having rectangular cross-sections.

There is illustrated in FIG. 15 a cross-sectional view of the filling pipe of FIG. 13 along the 15—15 line. As shown in FIG. 15, the fill pipe 40 may have an indentation 324 for engaging with the collar of a nozzle 80. In this manner, the nozzle 80 is more securely fastened to the fill pipe 40. There is illustrated in FIG. 16 a cross-sectional view of the filling pipe of FIG. 13 along the 16—16 line. As shown in FIG. 16, the transformation of the cross-sections of the various portions 314, 316 and 318 of the elongate body 304 is very clearly seen. The cross-section of portion 314 is substantially circular while the cross-section of portion 316 is elliptical. The cross-section of portion 318 is still more elliptical than the cross-section of portion 316.

There is illustrated in FIG. 17 a top perspective view of a fill pipe of the present invention. There is illustrated in FIG. 18 a bottom plan view of the fill pipe of FIG. 17. As previously mentioned, the cross-section of the elongate body 304 becomes more elliptical near the outlet end 302 while the inlet end 300 has a circular cross-section. The inlet end 300 also has a flange 326 to prevent leakage from the pump mechanism to the fill pipe 40.

There is illustrated in FIG. 19 a side view of an alternative embodiment of a fill pipe of the present invention. There is illustrated in FIG. 20 a cross-sectional view of the fill pipe of FIG. 19 along the 20—20 line. There is illustrated in FIG. 21 is a top perspective of the fill pipe of FIG. 19. There is illustrated in FIG. 22 a top plan view of the fill pipe of FIG. 19. Instead of a plurality of portions, this embodiment of the fill pipe 40 has an elongate body 304 without division into further small components. The cross-section of the elongate body gradually transforms from having a circular cross-section near the inlet end 300, to having an elliptical cross-section towards the outlet end 302. From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. A fill system for a packaging machine comprising:

a container having a cross-section defined by a plurality of sidewalls, an interior bottom engaging the sidewalls, and an open top;

a fill pump for pumping a liquid product;

a fill pipe comprising an elongate body having an interior passageway, at least a portion of the interior passageway having an elliptical cross-section, an inlet end for flow communication of the liquid product under pressure between the fill pump and the interior passageway, and an outlet end in flow communication with the interior passageway, the outlet end dispensing the liquid product from the fill pipe into the nozzle, the outlet end having an elliptical cross-section;

a nozzle disposed over the outlet end of the fill pipe, the nozzle comprising a collar for connecting the nozzle to the outlet end of the fill pipe and a plurality of flaps formed from a flexible material and extending from the collar, the plurality of flaps being biased to a closed state, the nozzle sealing the outlet end of the fill pipe when in the closed state;

moving means for relatively moving the container and nozzle toward one another at a first position in which the nozzle is disposed in the interior bottom of the container and a second position in which the nozzle is disposed distal from the interior bottom of the container;

the fill pump operating to pump the liquid product through the fill pipe under pressure when the container and nozzle are disposed in their relative first position to thereby urge the flaps of the nozzle from the closed state to an open state, the flaps of the nozzle being dimensioned to substantially conform and seal with the sidewalls of the container when the flaps are urged to the open state to thereby inhibit mixing of air and product as liquid product is dispensed into the container through the nozzle and the moving means is operated to relatively move the container and nozzle from the first position to the second position.

2. The fill system according to claim 1 wherein the container sidewalls define a rectangular cross-section.

3. The fill system according to claim 1 wherein the plurality of flaps are dimensioned to seal substantially with the sidewalls of the container at the engagement between the sidewalls and bottom of the container when the container and nozzle are in the first position and the nozzle is in the open state.

4. The fill system according to claim 1 wherein the collar is composed of a silicone material of a predetermined durometer capable of maintaining the nozzle on the outlet end of the fill pipe during operation of the packaging machine.

5. The fill system according to claim 1 wherein the container sidewalls define a 95 mm×70 mm cross-section.

6. The fill system according to claim 1 wherein the entire interior passageway has an elliptical cross-section.

7. The fill system according to claim 1 wherein the inlet end has a circular cross-section.

8. The fill system according to claim 1 wherein at least a portion of the interior passageway nearest the inlet end has a circular cross-section.

9. The fill system according to claim 1 wherein the elongate body of the fill pipe is composed of a plurality of portions, the portion adjacent the inlet end having a circular cross-section and the portion adjacent the outlet end having an elliptical cross-section, each of the other portions having cross-sections which are gradually more elliptical the closer the portion is to the outlet end thereby gradually transforming the cross-section of the fill pipe from a circular cross-section at the inlet end to an elliptical cross-section at the outlet end.

10. The fill system according to claim 1 wherein the plurality of flaps comprise a plurality of V-shaped lugs formed from a flexible material extending from the collar, the V-shaped lugs each having a side corner portion having vertices spaced at corners that are disposed for alignment with the corner sections of the container, adjacent V-shaped lugs being joined to one another by inwardly turned flaps being dimensioned to substantially seal with the sidewalls of the container to be filled when the V-shaped lugs and inwardly turned flaps are in an open state to thereby inhibit mixing of air and liquid product during filling of the container.

11. The fill system according to claim 10 wherein the nozzle comprises four V-shaped lugs for alignment with the corner sections of a rectangular container.

12. A fill pipe for utilization in conjunction with a packaging machine for filling containers that have sidewalls defining a cross-sectional area, the packaging machine having a fill pump for pumping a flowable material, the fill pipe comprising:

an elongate body having an interior passageway, at least a portion of the interior passageway having an elliptical cross-section;

an inlet end for flow communication between the fill pump and the interior passageway; and an outlet end in flow communication with interior passageway, the outlet end dispensing the flowable material from the fill pipe, and the outlet end having an elliptical cross-section.

13. The fill pipe according to claim 12 wherein the entire interior passageway has an elliptical cross-section.

14. The fill pipe according to claim 12 wherein at a portion of the interior passageway nearest the inlet end has a circular cross-section.

15. The fill pipe according to claim 12 wherein the elongate body comprises a plurality of portions, the portion adjacent the inlet end having a circular cross-section and the portion adjacent the outlet end having an elliptical cross-section, each of the other portions having cross-sections which are gradually more elliptical the closer the portion is to the outlet end thereby gradually transforming the cross-section of the fill pipe from a circular cross-section at the inlet end to an elliptical cross-section at the outlet end.

16. The fill pipe according to claim 12 wherein the sidewalls of the container define a rectangular cross-section.

17. The fill pipe according to claim 12 wherein the sidewalls of the container define a cross-section of 95 mm×70 mm.

18. The fill pipe according to claim 12 wherein the elongate body is composed of a plastic material.

19. The fill pipe according to claim 12 wherein the elongate body is composed of a stainless steel material.

20. The fill pipe according to claim 12 wherein the container sidewalls define an octagonal cross-section.

21. The fill pipe according to claim 12 wherein the container sidewalls define a hexagonal cross-section.

22. The fill pipe according to claim 12 wherein the container sidewalls define a circular cross-section.

23. The fill pipe according to claim 12 wherein the flowable material is a liquid food product.

24. The fill pipe according to claim 12 wherein the flowable material is milk.

25. The fill pipe according to claim 12 wherein the inlet end has a circular cross-section.

26. The fill pipe according to claim 25 wherein the elliptical cross-section of the outlet end and at least a portion of the elongate body provide for a fill pipe capable of filling a container with the liquid product at a velocity at least twenty percent slower than a second fill pipe having an entirely circular cross-section with a circumference substantially equal to the circumference of the inlet end of the fill pipe.

27. The fill pipe according to claim 12 further comprising a nozzle connected to the outlet end of the fill pipe, the nozzle comprising:

a collar for connecting to the nozzle to the outlet end of the filling pipe, the collar having an elliptical cross-section; and a plurality of flaps formed from a flexible material and extending from the collar, the plurality of flaps being biased to a closed state, the nozzle sealing the outlet end of the fill pipe when in the closed state.

28. The fill pipe according to claim 27 wherein the collar is composed of a silicone material of a predetermined durometer capable of maintaining the nozzle on the outlet end of the fill pipe during operation of the packaging machine.

29. A method for filling a container with a flowable material, the method comprising:

providing a container having sidewalls defining a predetermined cross-section;

positioning the container beneath a fill pipe of a filling machine, the fill pipe comprising an elongate body having an interior passageway, at least a portion of the interior passageway having an elliptical cross-section, an inlet end for flow communication between a fill pump and the interior passageway; and an outlet end in flow communication with interior passageway, the outlet end having an elliptical cross-section;

bringing a bottom portion of the container and a nozzle that is disposed at the outlet end of the fill pipe proximate to one another;

pumping a flowable material through the fill pipe, through the nozzle and into the container; and moving the bottom of the container and the nozzle away from one another as the container is filled with the flowable material, the movement being controlled to maintain a lower end of the nozzle slightly above a level of the flowable material in the container.

30. The method according to claim 29 wherein the entire interior passageway has an elliptical cross-section.

31. The method according to claim 29 wherein the inlet end has a circular cross-section.

32. The method according to claim 29 wherein at least a portion of the interior passageway nearest the inlet end has a circular cross-section.

33. The method according to claim 29 wherein the sidewalls of the container define a rectangular cross-section.

34. The method according to claim 29 wherein the container sidewalls define an octagonal cross-section.

35. The method according to claim 29 wherein the container sidewalls define a hexagonal cross-section.

36. The method according to claim 29 wherein the flowable material is a liquid food product.

37. The method according to claim 29 wherein the elongate body comprises a plurality of portions, the portion adjacent the inlet end having a circular cross-section and the portion adjacent the outlet end having an elliptical cross-section, each of the other portions having cross-sections which are gradually more elliptical the closer the portion is to the outlet end thereby gradually transforming the cross-section of the fill pipe from a circular cross-section at the inlet end to an elliptical cross-section at the outlet end.

38. The method according to claim 29 wherein the elliptical cross-section of the outlet end and at least a portion of the elongate body provide for a fill pipe capable of filling a container at a velocity at least twenty percent lower than a fill pipe having a circular cross-section with a circumference substantially equal to the circumference of the inlet end.

39. The method according to claim 29 wherein the nozzle comprises:

a collar for connecting to the nozzle to the outlet end of the filling pipe, the collar having an elliptical cross-section; and a plurality of flaps formed from a flexible material and extending from the collar, the plurality of flaps being biased to a closed state, the nozzle sealing the outlet end of the fill pipe when in the closed state.

40. The method according to claim 39 wherein the collar is composed of a silicone material of a predetermined durometer capable of maintaining the nozzle on the outlet end of the fill pipe during operation of the packaging machine.

* * * * *